US006113668A

United States Patent [19]

Kneringer et al.

[11] Patent Number: 6,113,668

[45] Date of Patent: Sep. 5, 2000

[54] PROCESS FOR MANUFACTURE OF POWDER COMPACT FEED MATERIALS FOR FINE GRAINED HARDMETAL

[75] Inventors: Günter Kneringer; Wolfgang Köck; Joachim Resch, all of Reutte, Austria

[73] Assignee: Schwarzkopf Technologies Corp., Reutte/Tirol, Austria

[21] Appl. No.: 08/962,102

[22] Filed: Oct. 31, 1997

[30] Foreign Application Priority Data

Nov. 4, 1996 [AT] Austria ..... 1912/96

[51] Int. Cl.[7] ..... B22F 9/22

[52] U.S. Cl. ..... 75/351; 75/359; 75/369; 148/237

[58] Field of Search ..... 75/333, 351, 359, 75/369; 266/202; 264/8; 148/237

[56] References Cited

U.S. PATENT DOCUMENTS

| | | | |
|---|---|---|---|
| 3,234,007 | 2/1966 | Blocher, Jr. et al. . | |
| 4,402,737 | 9/1983 | Kronewetter et al. . | |
| 4,762,695 | 8/1988 | Endo et al. . | |
| 4,859,236 | 8/1989 | Patrician et al. . | |
| 5,073,193 | 12/1991 | Chaklader et al. | 75/345 |
| 5,110,565 | 5/1992 | Weimer et al. . | |
| 5,125,964 | 6/1992 | Buerkel et al. . | |
| 5,201,940 | 4/1993 | Batterham et al. . | |
| 5,352,269 | 10/1994 | McCandlish et al. | 75/351 |
| 5,482,532 | 1/1996 | Isshiki et al. | 75/333 |
| 5,658,395 | 8/1997 | Wahlberg et al. | 75/351 |
| 5,746,803 | 5/1998 | Dunmead et al. | 148/237 |

FOREIGN PATENT DOCUMENTS

| | | |
|---|---|---|
| 0 197 271 | 4/1989 | European Pat. Off. . |
| 48191 | 8/1969 | German Dem. Rep. . |
| 286 312 | 1/1991 | German Dem. Rep. . |
| 1 583 912 | 10/1970 | Germany . |
| 21 22 499 | 3/1978 | Germany . |
| 27 16 082 | 10/1978 | Germany . |
| 33 41 154 | 5/1985 | Germany . |
| 41 27 567 | 3/1992 | Germany . |
| 42 14 723 | 11/1993 | Germany . |
| 59-113104 | 6/1984 | Japan . |
| 63-45310 | 2/1988 | Japan . |
| 441769 | 1/1968 | Switzerland . |
| 91/07244 | 5/1991 | WIPO . |
| 92/03581 | 3/1992 | WIPO . |
| 93/02962 | 2/1993 | WIPO . |
| 95/04703 | 2/1995 | WIPO . |
| 97/16275 | 5/1997 | WIPO . |

*Primary Examiner*—George Wyszomierski
*Attorney, Agent, or Firm*—Morgan & Finnegan, LLP

[57] ABSTRACT

The manufacture of powdered feed materials for hard fine grained metal body production includes the reduction of metal oxides into powdered metal and the subsequent carburization into metal carbide. Processes currently used are very cost intensive, mainly because of very long reaction times at high temperatures. According to applicant's economical process, the above reactions occur in the range of seconds and in a high-temperature cyclone as the reaction chamber. The apparatus is rather simple to construct. The stock to undergo reaction is continuously introduced into the chamber as a solid powdered phase with reaction gas and/or carrier gas, and passes through the chamber on predetermined paths for reaction, without leaving the solid state thereby.

9 Claims, 1 Drawing Sheet

PROCESS FOR MANUFACTURE OF POWDER COMPACT FEED MATERIALS FOR FINE GRAINED HARDMETAL

The invention concerns a process for manufacturing starting powder material, ready for compacting and leading finally to a fine grained hardmetal body on a metal carbide basis, which proceeds from metal oxide powder or from reducible hardmetal compounds and comprises the procedural steps of reduction of the oxide or the metal compound into metal carburization of the metal mechanical-chemical powder particle dressing and/or mixing process.

BACKGROUND OF THE INVENTION

The quality which can be obtained for a hardmetal grade depends considerably on the nature of the starting powder materials which are formed into a shaped hardmetal body by pressing and sintering. The chemical-metallurgical composition in this case is just as significant as the morphology and structure of the powder, and therefore the dressing of the powder before press compaction and sintering.

In recent years, efforts for manufacturing improved hardmetal qualities were concentrated primarily on the attainment of fine graininess and homogeneity of the hard materials in the hardmetal.

The metallic components in the hardmetal's carbide-hard material phase are tungsten or titanium, and small amounts of the refractory metals tantalum, niobium, molybdenum, vanadium, and chromium in the form of grain-stabilizing composite carbides.

In the long procedural sequence of ore dressing these metals, the processing steps, starting with the reduction of powdered metallic oxides or comparable compounds like ammonium metalates and metallic acids, up to the extraction of metal carbide, are essential for the later quality of hardmetal types, particularly in regard to their metallic structure.

Metal oxides, or comparable compounds familiar to a skilled person, are reduced to pure metal in one or more processing steps, and the metal is subsequently converted to metal carbide, usually in a separate processing step. In rare cases, reduction and carburization are also carried out in one common continuous process.

For metal oxide reduction in a solid-gas reaction, metal oxides are continuously led through a reduction furnace on carrier saggers in comparatively thin layers. Reduction in a rotary kiln and in a fluidized bed are equally well known.

Conventional processes for carbide production are the intimate mixing of powdered metal, tungsten powdered metal for example, with carbon (carbon black particles) and subsequent reaction in a carburizing furnace.

Besides powder quality, the economics of production play an important role in commercial production. It is determined by the price of the device corresponding to the process's complexity, by the amounts of energy and reaction gas used for each reaction unit, and, above all, by the factor of production time.

The reaction or processing times of the powder in each of the cited devices, without exception, lie in the range of hours, 1 to 2 hours in the most favorable case, reaction times of 15 to 20 hours in the most unfavorable cases.

Besides the chemical steps of reduction and carburization, procedural steps like grinding and mixing events, which as a rule again take many hours, belong to the complete production. Additionally, the processes for dressing powder, like the granulation of powders by spray drying for example, are largely unavoidable in the hardmetal industry.

New processes, in which conventional reduction and carburization, including special powder preparation and dressing procedures, run simultaneously or at a compelling pace, were developed in connection with the demand for submicron and nanophase powders for hardmetal feed materials.

WO 91/07244 entitled "Sprühumwandlungsprozeß für die Herstellung von Nanophasen-Verbundpulver" and WO 95/04703 entitled "Verfahren zur Herstellung von Submikrometer-Karbiden, Submikrometer-Mischkristallkarbiden und daraus entstehende Materiallen" are representative for these types of processes and devices used for them, whereby the latter patent document makes a reference to U.S. Pat. No. 5,110,565 in which a reactor is described as it is used for carrying out the process in accordance with the WO application.

The high manufacturing costs and costs for the devices are disadvantageous in these processes. In spite of some reductions relative to the known state of technology at the time, the reaction times, as a whole, for the unavoidable procedural steps to be carried out are still on the order of one to several hours, and are therefore a substantial cost factor. These processes are therefore uneconomical, as a whole, particularly as regards the achievement of powder fine graininess in comparison with the standard processes described farther toward the beginning.

SUMMARY OF THE INVENTION

It is therefor an object of the present invention to provide a process for manufacturing starting powder materials for fine grained hardmetal body manufacturing, which is economical in comparison to the state of technology, and which enables the manufacture of high quality hardmetal grades, especially fine grained types.

The object of the present invention also comprises the choice of a suitable device for carrying out the process, whereby devices of this type are indeed known for the chemical conversion of various organic and inorganic materials, but have not been previously used for manufacturing starting powder materials for attainment of homogenous fine grained hardmetal bodies.

The objects of the invention are accomplished in accordance with the invention as set forth in the process according to the claims.

Under the name Cermet, the term "hardmetal" in the claims also includes materials which also contain substantial portions of nitrides or carbonitrides, besides carbides, in the hard material phase.

The process in accordance with the invention requires the application of a reaction chamber which is well known under the concept of "Cyclone."

DETAILED DESCRIPTION OF THE INVENTION

Cyclones are characterized in that they have axially or rotationally symmetrical chamber walls as a rule. The stock to undergo reaction, in the form of hard particles, is immediately intimately mixed and swirled with carrier and/or reaction gas upon entry to the reaction chamber, and is continuously blown as a mixture in a direction divergent from the chamber's axis. The materials introduced in this way move in essentially predetermined orbits under the effect of gravitation and centrifugal forces corresponding to the relationships of the gas stream governing the chamber, that is, not in a statistical movement as in a fluidized bed oven, for example. The gas and particle stream is preset by the chamber walls, including possible directing elements mounted there.

High speeds of flow tangential to these chamber walls will occur. Large relative velocities between solid and gaseous materials appear in the reaction chamber. Large velocity gradients between individual materials mean large intensities of turbulence and cause large thermal and material exchange rates for the various reactants in the intended chemical reaction.

The device and process establish that the reaction stock's stay in the chamber is short. The stay and reaction times are each between tenths of a second and approximately one minute depending on the system's arrangement.

Cyclone reactors of this kind have been used for the pyrolysis of sawdust: J. Lede et al, "Flash Pyrolysis of Wood in a Cyclone Reactor", Chem. Eng. Proc. 20 (1986), pp. 309–317; J. Cousins et al, "Gasification of Sawdust in an air blown cyclone Gasifier", Ind. Eng. Chem. Process Des. Dev. 24 (1985), pp. 1281–1287; for combustion of slag as well as sludge residues, T. Murakami et al, "Characteristics of Melting Process for Sewage Sludge", Wat. Sci, Tech. 23 (1991), pp. 2018–2028. Finally, the processes also have application to exothermal metallurgical processes, for the melting of copper concentrates containing copper, lead, and zinc for example, as described in DE 33 41 154 and in the technical paper "Das Schwebeschmelzen und andere leistungsintensive Prozesse", A. Lange, Erzmetall 13 (1960), pp. 151–159.

It is nevertheless common to all processes currently carried out in cyclones, including metallurgical processes in particular, that the stock which undergoes reaction is introduced into the cyclone as solid particles, that the solid particles are nevertheless transformed into the liquid or mostly gaseous phase for carrying out the desired reaction, and that the reaction materials desired at the end, including reduced metals in particular, leave the cyclone in gaseous or molten form.

In all cases, however, chemical reactions proceed more rapidly in the molten or gaseous phase than in the solid phase and thereby suit the short stay and reaction times in the cyclone, and seem unavoidable to the artisan.

Experimental value from cyclone reactions in which at least one reactant was maintained in the solid phase were therefore not available. The technically and commercially satisfactory conduction of a cyclone process controlled in this way was therefore neither taught nor obvious.

Unlike chemical reactions in the cyclone according to the state of technology, the reduction and/or carburization of correspondingly solid particles must proceed while maintaining the solid phase. In the case of the cyclone reaction, liquefaction and/or volatilization of the solid particles and subsequent sublimation would lead to end products (powders) which, because of their structural nature, would not be suitable for further processing into hardmetal bodies of the quality customary today.

An essential advantage of the process of the invention relative to the well known processes for producing submicron or nanophase powders for starting powder materials for manufacturing fine grained hardmetal bodies, consists in that powdered input stock (metal compounds to be reduced) can be used without special supplemental treatment as they are made ready from the ore dressing, and can be processed into hardmetal of very uniform and fine grained structure after applying this process.

The powder feed materials produced by the present process enable the attainment of hard fine grained metal body qualities which correspond to or are even superior to those attained according to the processes, manufacture of monophase composite powder and manufacture of submicrometer carbides, described in the prior art processes mentioned hereinabove.

However, the reaction times for the chemical procedural steps, reduction and carburization, up until complete reaction for at least 90%, by volume, of the stock to undergo reaction in the solid phase in accordance with the present invention, are considerably below those of the well known procedures. A substantially larger profitability of the procedure under discussion is thereby given relative to the well known state of technology. The economic advantages of the present process additionally increase on the basis of a comparatively simple structural arrangement of cyclone reaction chambers, as well as comparatively favorable data about energy and gas consumption.

Metal oxides, or other standard compounds available for reduction to powdered metal, are usually made ready in particle sizes between approximately 2 and 30 $\mu$m and, after the process in accordance with the invention, produce powdered metal with approximately comparable particle sizes to the size of the starting powder, although with a significant portion of agglomerated powders.

Agglomerated powders are fundamentally not a good starting basis for the production of the highest fine grained hardmetal. It was nevertheless completely surprising that the powdered metals manufactured by chemical reduction according to the present invention exhibit an extremely high, spongy microporosity throughout in the region of 0.1 $\mu$m. The powdered metal thereby has a quality for farther processing into carbide and hardmetal possibly approaching that which is already known from the nanophase processes mentioned as well known. The powdered metal can be completely carburized in its entire volume in a cyclone reaction, and leads to a fine grained hardmetal quality never before attained.

According to one preferred execution of the chemical procedural step in the cyclone, the processing time of the stock to undergo reaction in the solid phase is 0.2 to 10 seconds, and this is for a complete chemical transformation into the predetermined reaction state for at least 90% of the solid phase by volume. The separate chemical procedural step in the cyclone may be repeated by at least one farther pass to increase the portion of the volume with complete chemical reaction.

According to another preferred execution of the process, supplementary metallic materials are added to the metal oxide power or to the powdered metal compound before the reduction step as the stock to be reduced, particularly the metals Co and/or Ni used in hardmetal as binding metals. This occurs by addition of metallic powder or again by manufacturing a solid solution in advance, that is, by introduction of supplementary materials into the solid phase of the stock to be reduced.

In accordance with some preferred executions, there occur the following variations for processes, involving several partial steps, for manufacturing powder compact feed materials for further processing into fine grained hardmetal, in accordance with the invention.

A first procedural variation of the process in accordance with the invention comprises reducing metal oxide of comparable metal compounds into powdered metal in the cyclone according to the cyclone process; also in a repetition of this reduction step in the case of high purity requirements for the powdered metal to be reduced.

The powdered metal obtained in this way is subsequently intimately mixed with carbon particles in a ball mill, as is frequently used in hardmetal production. Agglomerates of the spongy powdered metal are thereby pulverized. During this mixing and grinding process, it is advantageous to add powdered supplementary metals (for the formation of composite carbides as inhibitors of granular growth in hardmetal). The powder mixture is farther converted into metal carbide in a carburizing furnace according to conventional processes, mixed with the binding metal (powdered cobalt and/or nickel) by conventional standard processes, and transformed by optional attritor grinding and spray drying into a powder feed material ready for compacting. The powder compact feed material obtained in this way can be processed into very fine grained hardmetal bodies with very large phase homogeneity by conventional compacting and sintering processes.

According to a second variation, the metal oxides are reduced to powdered metal in the cyclone, as above. In distinction to the process described above, the powdered metal so obtained is likewise processed farther into metal carbide in the cyclone according to the cyclone process essential to the invention, in accordance with two subvariations, in fact, either with carbon particles (as above), in connection with previous external mixing, by simultaneous blowing in of this mixture into the reaction chamber together with carrier gas and possibly with reaction gas, or according to a second subvariation by direct blowing in of the powdered metal into the cyclone reactor in common with gaseous carbon compounds, particularly hydrocarbon gases and/or CO. Even this variation is completed by the conventional grinding, mixing, and granulating processes, whereby it is not obligatory for the grinding and granulating events to occur.

In accordance with a third preferred variation of the process, the metal oxides are blown into the cyclone reaction chamber in common with a reducing gas and a gas containing carbon, or blown in and, during a single complete pass, the reduction of the oxide to powdered metal first proceeds in a first part of a spatially united total reactor, and the carburizing of the reduced powdered metal into metal carbide proceeds immediately afterwards in a second part of the chamber.

As implemented for the first variation, besides the base metal, tungsten and/or titanium for example, supplementary metals like niobium, tantalum, vanadium, and chromium can also be added into the cyclone during the carburization process for composite carbide formation and be converted to carbides with the main metal simultaneously.

What has been stated above holds for the accompanying mixing, grinding, and granulating events, as well as their obligatory or optional application.

Figure 1:
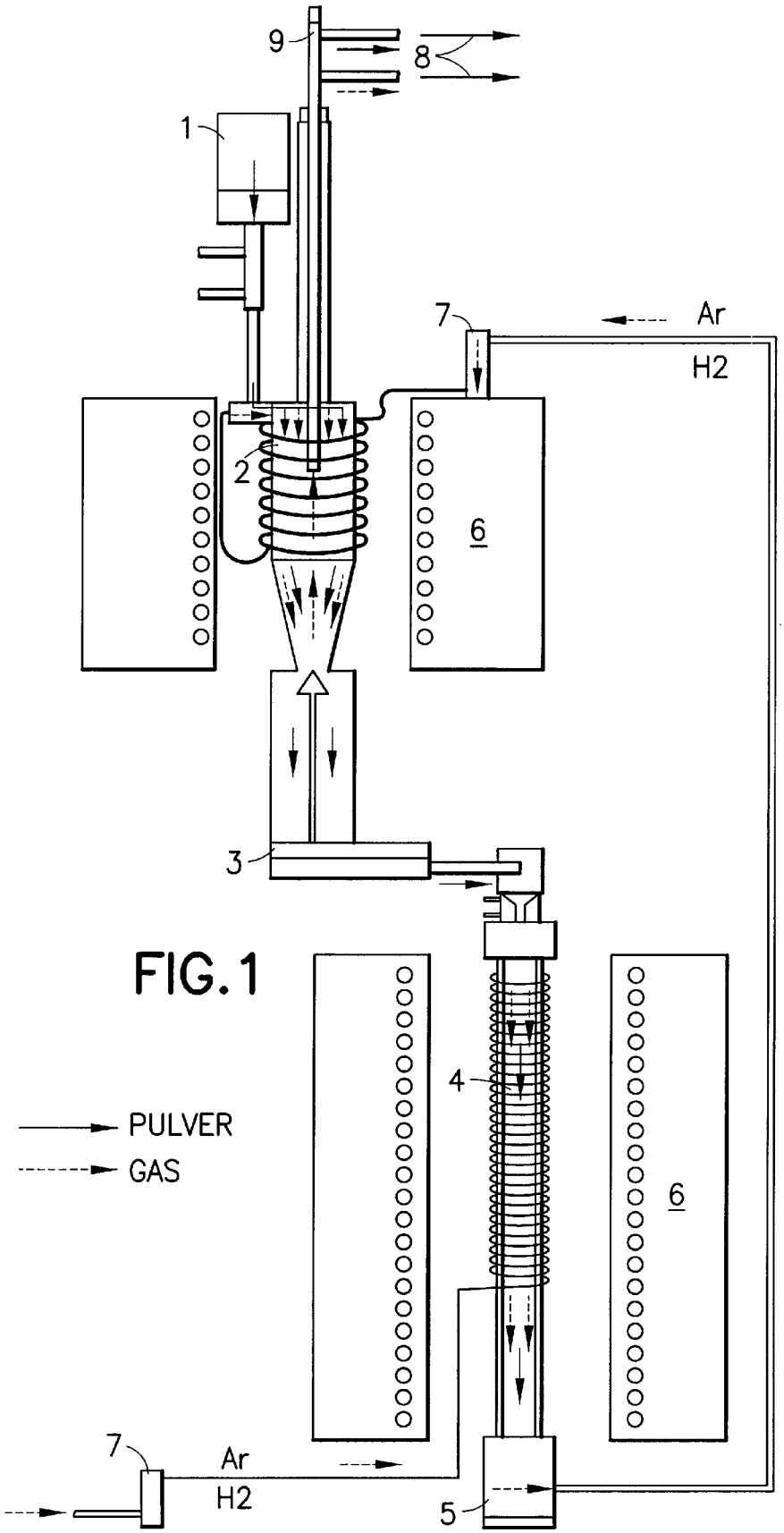
FIG. 1 shows a schematic of the apparatus used in the process of the present invention.

The process in accordance with the invention will be described in more detail on the basis of the following examples.

Although the foregoing invention has been described in some detail by way of illustration and example for purposes of clarity of understanding, it will be obvious to those skilled in the art that certain changes and modifications may be practiced without departing from the spirit and scope thereof as described in the specification and as defined in the appended claims.

EXAMPLE 1

A cyclone with the characteristics of the present invention and corresponding to the illustration in FIG. 1 is implemented as the device for carrying out the reduction process. The entire arrangement illustrated in FIG. 1 consists of a steel reaction chamber arranged as a cyclone, to which a second reaction chamber the reacted stock is downstream, whereby this after treatment and its associated reaction chamber are not part of the invention.

It therefore deals with a downscaled pilot facility in comparison with facilities for industrial production, which regards the throughput of the stock to be reduced in quantities per unit time.

In the first step, powdered $W_4O_{11}$, in common with reaction and/or carrier gas, is blown in accordance with the invention through a feeder device (1) into the head portion of a reaction chamber (2) which is approximately rotationally symmetric to the direction of fall. The quantity of gas is measured out by a flow meter (7). The reaction chamber is brought to a reaction temperature of 1100° (2012° F.) by an electrical heating device (6). The powdered reaction product exits the chamber at the lower end, falls into a storage with a conveying screw (3), and is introduced into the second reaction chamber (4) with heating a device (6) by this screw. The exhaust gas (8), reaction and/or carrier gas as well as $H_2O$ steam exit the first chamber at its head portion as the final reaction product.

In the second processing step, both the reacted stock, namely very pure powdered tungsten, and also the exhaust gases exit the vertically arranged tubular chamber at the lower end. The powdered tungsten is collected in a container (5).

The temperature control of the entire two-stage process occurs by means of a thermoelement (9) at the first reaction chamber's exhaust gas outlet.

For a continuously added throughput of powder of 1000 g $W_4O_{11}$ (tungsten oxide blue) per hour, a quantity of 4000 liters of $H_2$ gas is introduced, that is, a large excess of gas relative to the stoichiometric reaction quantities. Tungsten oxide, as the stock to be reduced, and $H_2$ as the carrier or reducing gas, are supplied to the cyclone separately. The carrier or reducing gas is introduced into the chamber , preferably horizontally, at the upper end with a high flow rate. The powdered stock to be reduced is delivered to the gas-inlet nozzle so that it is entrained by the gas jet upon entry into the chamber, intensively swirled and mixed with it, and passed through the chamber on predetermined orbits corresponding to the direction of the gas stream. The stock to be reduced to powdered tungsten exits the reduction chamber after 1–2 seconds of processing time and has a residual oxygen content of 10.500 $\mu$g/g upon exit. The powdered tungsten which is leaving has a particle size on the order of 20 $\mu$m in diameter comparable to the powder introduced, whereby the individual powder particles or grains nevertheless have a large porosity throughout their entire volume. The spacial expansion of the substructure in a tungsten particle is around 0.1 $\mu$m.

For manufacturing very pure powdered tungsten with a very low residual oxygen content, the reduction process is repeated once in the cyclone. The powdered tungsten produced in this way is converted into carbide according to conventional processes. For this, the powdered tungsten is first intensively mixed in the ball mill with a portion of fine carbon black particles, stoichiometric for tungsten carbide, WC. The individual agglomerates of the powdered tungsten are pulverized by this. The feed material produced this way is carburized for 3 hours at 1300° C. (2372° F.) under an $H_2$ atmosphere in a graphite resistance furnace with induction heating. It generates pure tungsten carbide with a carbon content of 6.12% and a residual oxygen content of 1200 μg/g.

The carbide is mixed with binding metal and the usual amounts of composite carbides (niobium carbide, tantalum carbide) and processed into pourable granularity by optional attritor grinding and spray drying.

Hardmetal samples, manufactured from these types of powdered feed materials by compacting and sintering according to conventional processes, have extraordinarily large fine graininess with very homogeneous hardmetal structure.

EXAMPLE 2

The device which is used corresponds to that of example 1, except that a downpipe is not downstream from the cyclone.

Tungsten oxide, blue, is reduced to powdered tungsten in the cyclone corresponding to the processing conditions given in example 1. Unlike example 1, the powdered tungsten is subsequently processed further into tungsten carbide as well with the aid of carbonaceous gases plus carrier gas ($CH_4/H_2$ mixture) in a cyclone reactor lined with graphite. The carburization occurs in one step at a cyclone temperature of 1100° C. (2012° F.).

A gas throughput of 6000 liters/hour is adjusted for a throughput of powdered tungsten of 1000 g/h. The methane concentration in the $CH_4/H_2$ mixture is 1.1% by volume. This corresponds to a C-activity of 0.8 g/mole at 1100° C. The powdered tungsten blown in exits the cyclone after 4 seconds as a mixture of $W_2C$ and WC, but without portions of uncombined carbon. The carbon content in the carbide is 4.5% by weight, the residual oxygen content 2390 μg/g. This includes an undeniable, decisive advantage, that reaction gas appears directly at the site of the reaction because of the starting powder's microporosity and the reducing speed is thereby high.

The mixture $W_2C$/WC thereby obtained is converted into pure tungsten carbide WC (C-content=6.12%) in a second pass through the cyclone reactor under approximately the same conditions as above.

Corresponding to example 1, powdered feed materials ready for compacting are completed by mixing the WC with binding material and small portions of composite carbides by optional granulation through spray drying.

The hardmetal obtained from these powdered feed materials corresponds to that of example 1 in its fine grained structure and homogeneity.

EXAMPLE 3

Arrangement of the cyclone device and reduction process of tungsten oxide into powdered tungsten in two successive passes conforms to that of example 1.

The subsequent carburization again occurs in the cyclone reactor, but, unlike example 2, with use of CO as carburizing gas and carrier gas. The powdered tungsten produced from the cyclone reactor is then continuously brought into the chamber at a throughput of 1000 g/h with a quantity of 6000 l/h of gas (CO gas), and undergoes reaction into $W_2C$ and WC (C-content 4.2% by weight) and a residual oxygen content of 3240 μg/g in a one-step process at a chamber temperature of 1000° C. (1832° F.). The X-ray diffractometer test shows small amounts of WC besides the $W_2C$, but no uncombined carbon is present in the end product obtained this way. The processing time for the particles to be carburized in the cyclone reactor is 1–2 seconds.

In a second procedural step in the cyclone under approximately the same experimental conditions as in the first carburizing step, the $W_2C$ - WC powder mix obtained this way undergoes farther reaction into pure tungsten carbide WC, with only very small residual oxygen content and without detectable residues of uncombined carbon.

The completion of the powdered feed material by mixing and by optional granulation occurs as in examples 1 and 2.

A hardmetal manufactured from these feed materials by conventional processes has a high fine graininess and high material homogeneity.

What is claimed is:

1. A process for manufacturing a starting powder material useful for compacting and making fine grained hardmetal bodies, beginning from a metal oxide powder or from a reducible hard metal compound, said process comprising the steps of:

reducing the oxide or the metal compound into metal;

carburizing of the metal;

performing a mechanical-chemical powder particle dressing and/or mixing process;

said process further comprising the step of utilizing a cyclone device and a cyclone process in at least one of the reducing and carburizing steps;

wherein the device is a temperature controlled reaction chamber, arranged at least in sections in approximately rotational symmetry around a longitudinal axis with admission and outlet openings for powdered stock to undergo reduction and/or to be carburized and for reacting gas with the stock and for carrier gas, the powdered stock, carrier gas and reacting gas being continuously introduced into the reaction chamber, and wherein the continuously introduced powdered stock, while maintaining the solid state, passes through the reaction chamber with high powder velocities on paths orbiting the longitudinal axis with velocity components tangential to chamber walls of the device at least in sections, the powdered stock being guided through the reaction chamber based upon the direction and velocity of the powdered stock upon entry, as well as by flow parameters of carrier and/or reaction gas at the entry, and wherein the powdered stock exits the device at least with a portion of 90% by volume having undergone chemical reaction of reduction and/or carburization in 0.1–60 seconds after admission.

2. The process for manufacturing a starting powder material according to claim 1, wherein a processing time for the chemical reaction of the powdered stock is 0.2–10 seconds.

3. The process for manufacturing a starting powder material according to claim 2, wherein large relative velocities between solid and gaseous materials appear in sections near the outlet of the device.

4. The process for manufacturing a starting powder material according to claim 2, wherein at least one of the two procedural steps, reduction and carburization, are repeated at least once.

5. The process for manufacturing a starting powder material according to claim 1, wherein large relative velocities between solid and gaseous materials appear in sections near the outlet the of the device.

6. The process for manufacturing a starting powder material according to claim 5, wherein at least one of the two procedural steps, reduction and carburization, are repeated at least once.

7. The process for manufacturing a starting powder material according to claim 1, wherein at least one of the two procedural steps, reduction and carburization, are repeated at least once.

8. The process for manufacturing a starting powder material according to claim 1, 2, 3, 4, 5, 6 or 7, wherein supplementary metallic materials are added to the powdered metal oxide or the powdered metal compound before reduction in the form of separate powders or by advance formation of a solid solution in the stock to undergo reaction.

9. The process for manufacturing a starting powder material according to claim 1, further comprising the steps of:

utilizing the cyclone device in the reduction step; and utilizing a carburization furnace in the carburization step.

* * * * *